US012098898B2

(12) United States Patent
Noonan et al.

(10) Patent No.: US 12,098,898 B2
(45) **Date of Patent: *Sep. 24, 2024**

(54) BACKSTRAP ASSEMBLY FOR A FIREARM

(71) Applicants: Paul T. Noonan, Boise, ID (US); Tingwu Song, Palos Verdes, CA (US); Aaron Neal Trout, Fayetteville, AR (US)

(72) Inventors: Paul T. Noonan, Boise, ID (US); Tingwu Song, Palos Verdes, CA (US); Aaron Neal Trout, Fayetteville, AR (US)

(73) Assignee: F. M. Products Inc, Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/246,949

(22) Filed: May 3, 2021

(65) Prior Publication Data

US 2021/0270553 A1 Sep. 2, 2021

Related U.S. Application Data

(63) Continuation of application No. 16/250,208, filed on Jan. 17, 2019, now Pat. No. 11,022,388.

(60) Provisional application No. 62/618,696, filed on Jan. 18, 2018.

(51) Int. Cl.
*F41A 3/66* (2006.01)
*F41C 23/10* (2006.01)

(52) U.S. Cl.
CPC ..... *F41A 3/66* (2013.01); *F41C 23/10* (2013.01)

(58) Field of Classification Search
CPC ..... F41A 23/10; F41A 19/14; F41A 19/15; F41A 19/43; F41A 19/47; F41A 19/48; F41C 23/10; F41C 3/66
See application file for complete search history.

(56) References Cited

U.S. PATENT DOCUMENTS

| | | | | |
|---|---|---|---|---|
| 4,520,585 | A * | 6/1985 | Barrett | F41C 23/10 42/7 |
| 4,570,370 | A * | 2/1986 | Smith | F41C 23/10 42/71.02 |
| 5,090,147 | A * | 2/1992 | Pastor | F41A 17/28 42/70.05 |
| 5,231,237 | A * | 7/1993 | Cupp | F41C 23/10 42/71.02 |
| 9,310,160 | B1 * | 4/2016 | DiChario | F41C 23/10 |
| 2001/0016999 | A1 * | 8/2001 | Williams | F41A 17/74 42/70.08 |
| 2006/0150466 | A1 * | 7/2006 | Hochstrate | F41A 19/13 42/69.03 |
| 2011/0219656 | A1 * | 9/2011 | McGarry | F41C 23/14 42/70.06 |
| 2012/0023801 | A1 * | 2/2012 | Rozum | F41A 17/00 42/70.08 |

(Continued)

OTHER PUBLICATIONS

Everglades. <https://www.youtube.com/watch?v=UlkdsIOSUOE>. Jan. 27, 2014. (Year: 2014).*

*Primary Examiner* — Gabriel J. Klein

(57) ABSTRACT

A backstrap assembly is disclosed. The backstrap assembly contains a cavity sized to retain a main spring cap, a main spring retainer, a main spring, and a lower end of a strut, and an opening for a pin, wherein the pin retains the main spring cap, the main spring retainer, and the main spring in the cavity.

11 Claims, 12 Drawing Sheets

(56) References Cited

U.S. PATENT DOCUMENTS

| | | | | |
|---|---|---|---|---|
| 2013/0036644 | A1* | 2/2013 | Bardy | F41A 19/14<br>42/69.01 |
| 2017/0205168 | A1* | 7/2017 | Chen | F41C 23/10 |

* cited by examiner

BACKSTRAP ASSEMBLY FOR A FIREARM

CROSS REFERENCE TO RELATED APPLICATIONS

This application claims the benefit of U.S. Provisional Application No. 62/618,696, filed on Jan. 18, 2018, which is incorporated herein by reference in its entirety. This application is a continuation of U.S. patent application Ser. No. 16/250,208 titled "Backstrap Assembly for a Firearm" filed Jan. 17, 2019, now issued U.S. Pat. No. 11,022,388, which is incorporated herein by reference in its entirety.

FIELD

The present invention relates to firearms. More particularly, the present invention relates to a backstrap assembly for a firearm.

BACKGROUND

The Model 1911 handgun is one of the most well-known and widely used handguns. Despite its popularity and long-standing use, there still exist drawbacks with this firearm. In particular, the Model 1911 handgun has a lot of parts and is complicated to assemble. A need exists for firearm that addresses the foregoing and other related and unrelated problems in the art.

In the following description, like reference numbers are used to identify like elements. Furthermore, the drawings are intended to illustrate major features of exemplary embodiments in a diagrammatic manner. The drawings are not intended to depict every feature of every implementation nor relative dimensions of the depicted elements, and are not drawn to scale.

DETAILED DESCRIPTION

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Backstrap assemblies and firearms incorporating such assemblies are presently disclosed.

Figure 1:
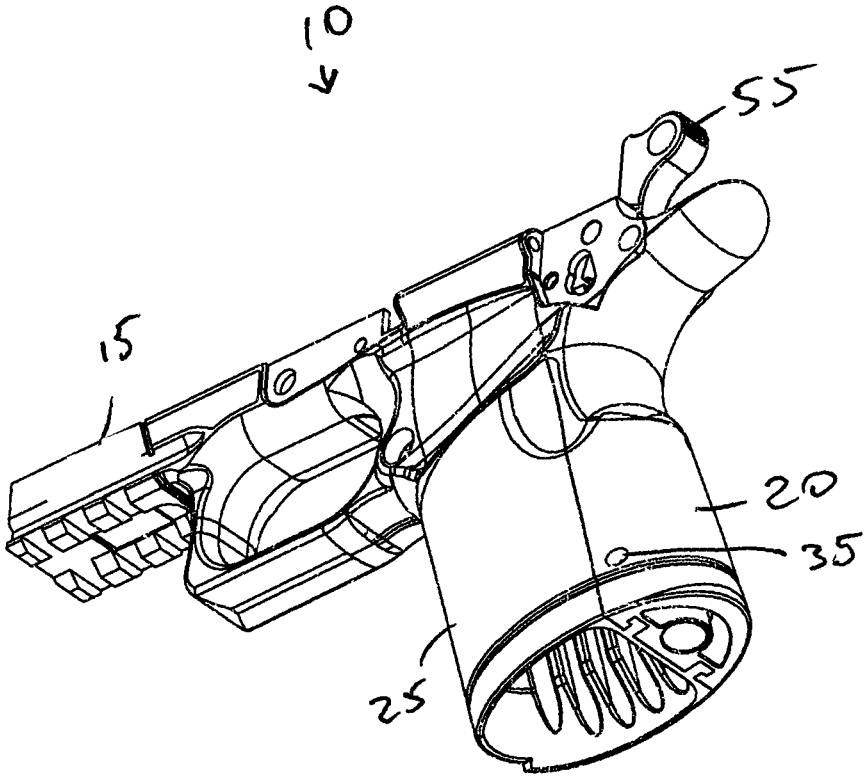
FIG. 1 depicts a portion of a handgun according to some embodiments presently disclosed.
Figure 2:
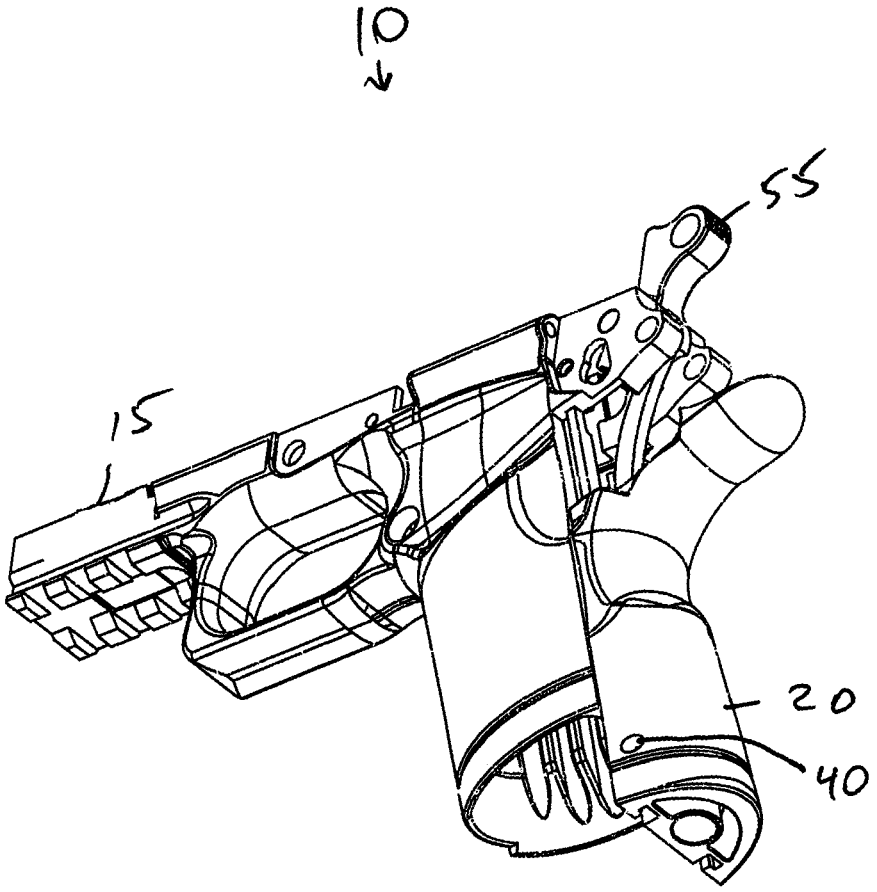
FIG. 2 depicts a backstrap assembly according to some embodiments presently disclosed separated from the handgun shown in FIG. 1.

Referring to FIGS. 1-2, a portion of a semi-automatic handgun 10 is shown according to some embodiments presently disclosed. The handgun 10 comprises a frame 15 and a backstrap assembly 20. For clarity of illustration, only those parts of the handgun 10 which relate to the construction and operation of the frame 15 and backstrap assembly 20 are shown.

Referring to FIGS. 1-2, the handgun 10 comprises a grip 25. According to some embodiments presently disclosed, the backstrap assembly 20 is slidably and removably coupled with the grip 25 as shown in FIG. 2. According to some embodiments presently disclosed, the grip 25 comprises tongue 50 (shown in FIGS. 3*a*-*b*) that extend out of grip 25 and correspond to groves 55 (shown in FIG. 4) that extend within the backstrap assembly 20. The tongue 50 and groves 55 combination of grip 25 and the backstrap assembly 20 enable the backstrap assembly 20 to travel up and down along the grip 25.

Figure 3A:
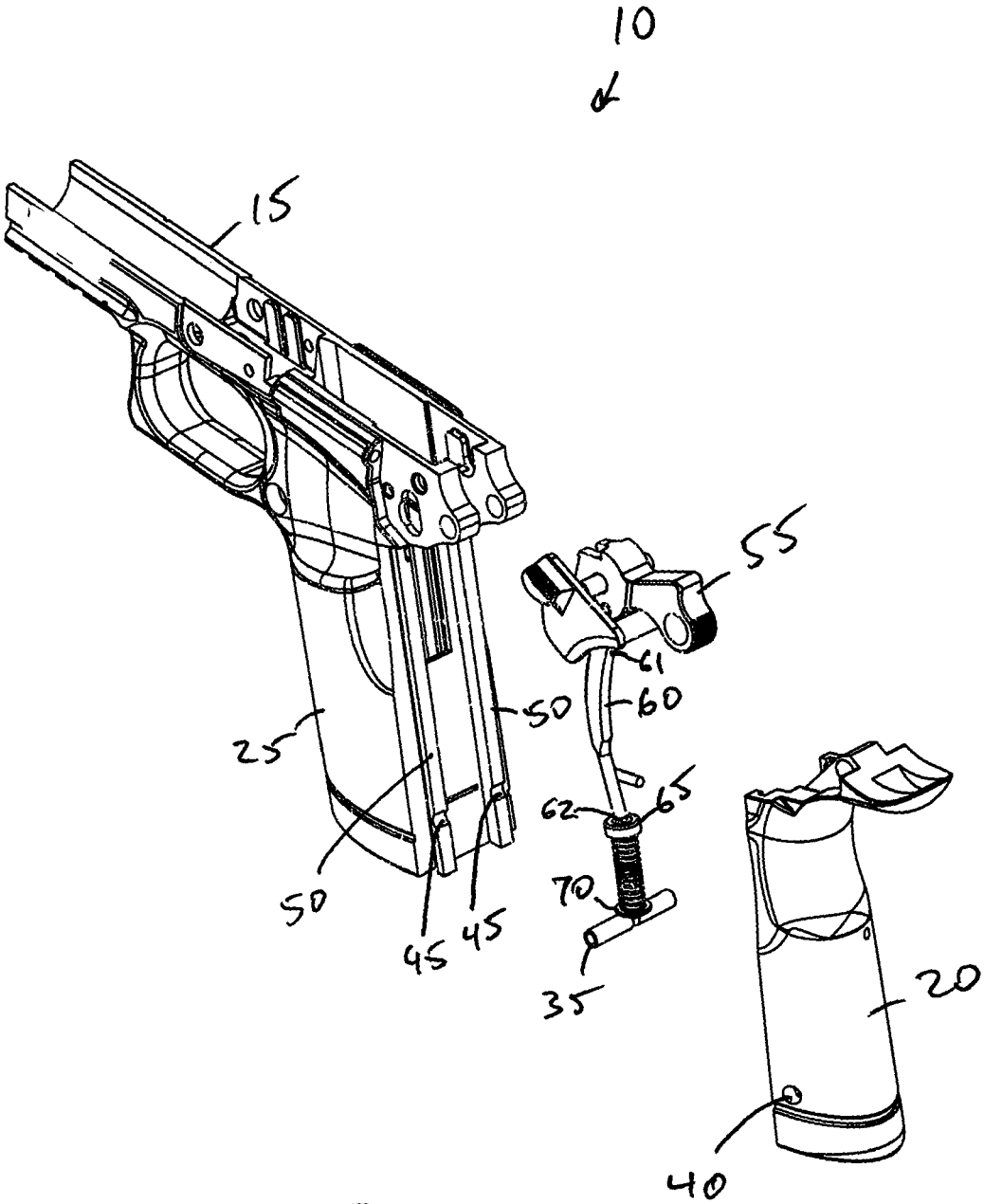
FIG. 3*a* depicts a backstrap assembly according to some embodiments presently disclosed removed from the handgun shown in FIG. 1.
Figure 3B:
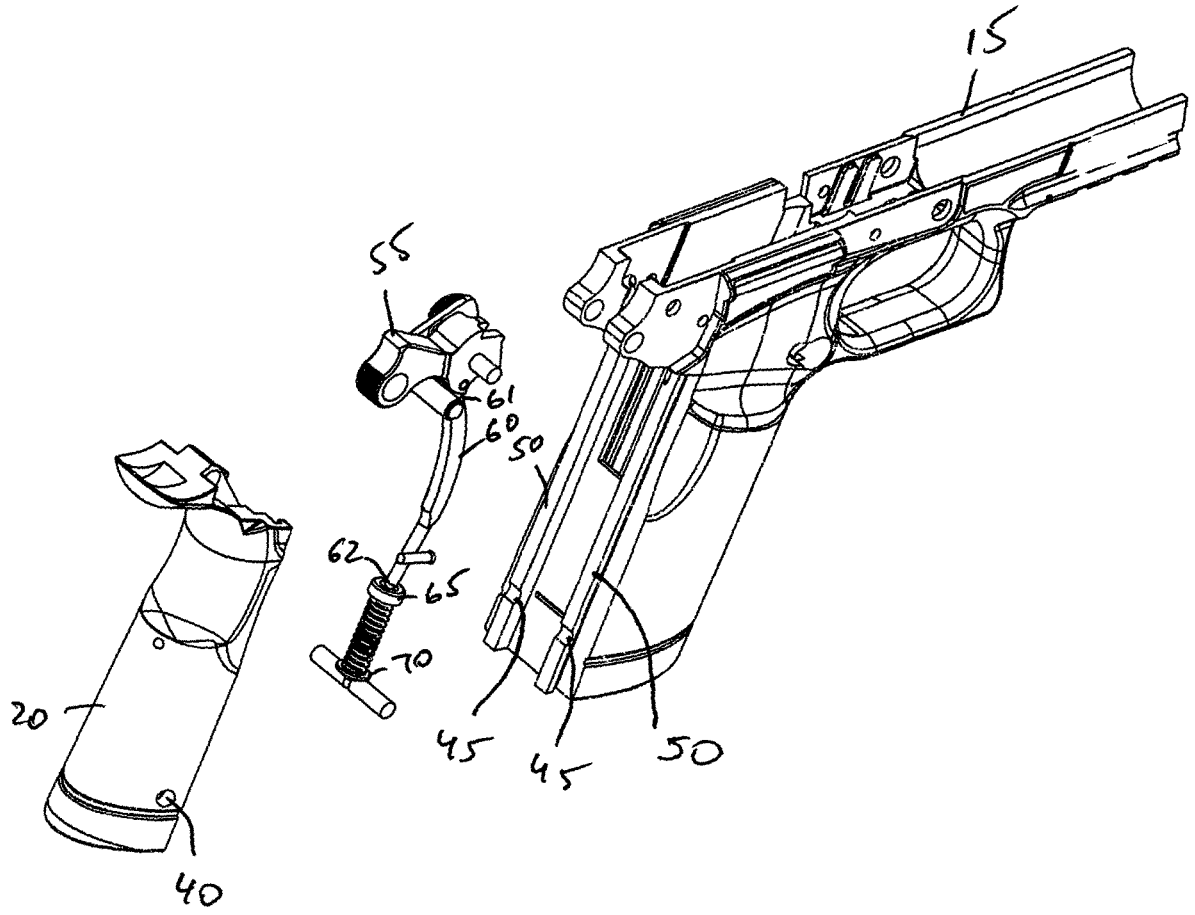
FIG. 3*b* depicts another view of the backstrap assembly according to some embodiments presently disclosed removed from the handgun shown in FIG. 3*a*.
Figure 4:
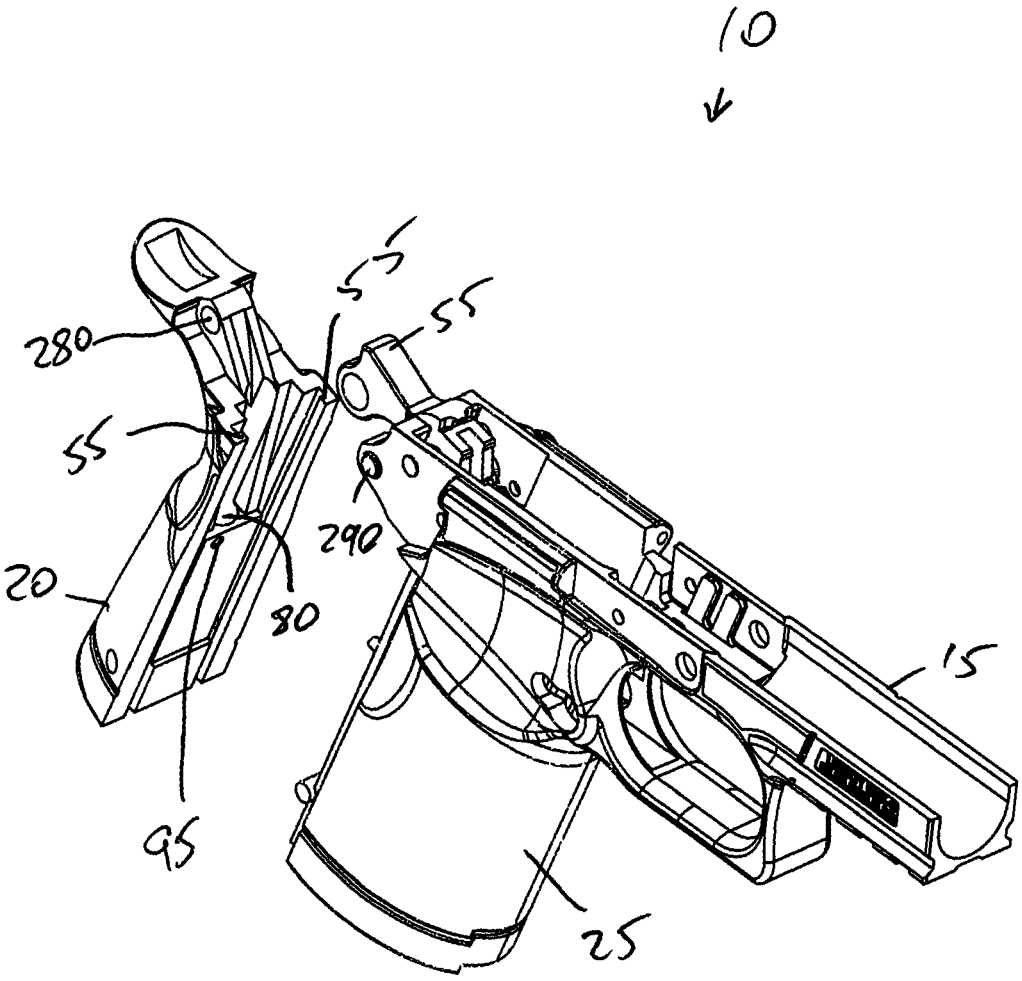
FIG. 4 depicts another view of the backstrap assembly according to some embodiments presently disclosed removed from the handgun.
Figure 5A:
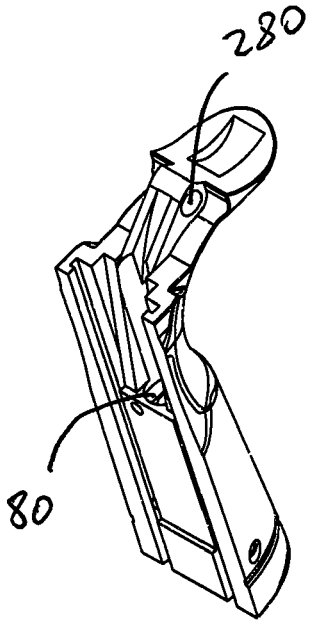
FIG. 5*a* depicts a perspective view of the backstrap assembly according to some embodiments presently disclosed.
Figure 5B:
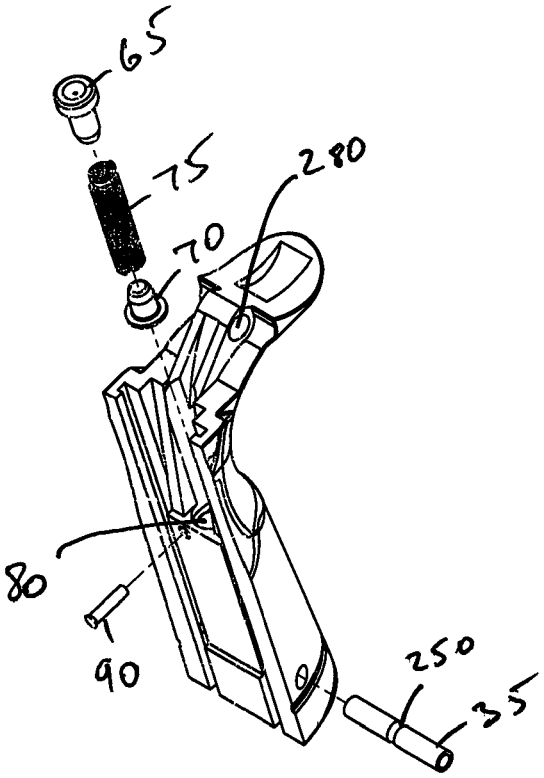
FIG. 5*b* depicts an exploded view of the backstrap assembly according to some embodiments presently disclosed.

A coupling pin 35 is shown for coupling the grip 25 and the backstrap assembly 20 by inserting it into opening 40 in the backstrap assembly 20 and engaging it with the notches 45 in the tongues 50 (shown in FIGS. 3*a*-*b*). According to some embodiments presently disclosed, the coupling pin 35 prevents the backstrap assembly 20 from sliding down the grip 25.

According to some embodiments presently disclosed, the handgun 10 comprises a hammer 55, a strut 60, a main spring cap 65, a main spring retainer 70, and a main spring 75. The strut 60 comprises an upper end 61 and a lower end 62. The upper end 61 of the strut 60 is associated with the hammer 55.

Figure 6A:
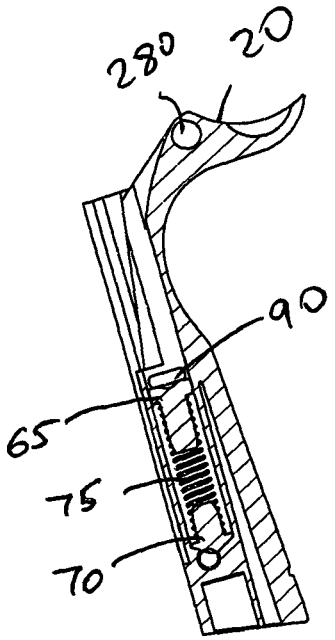
FIG. 6*a* depicts a side view of the backstrap assembly according to some embodiments presently disclosed.
Figure 6B:
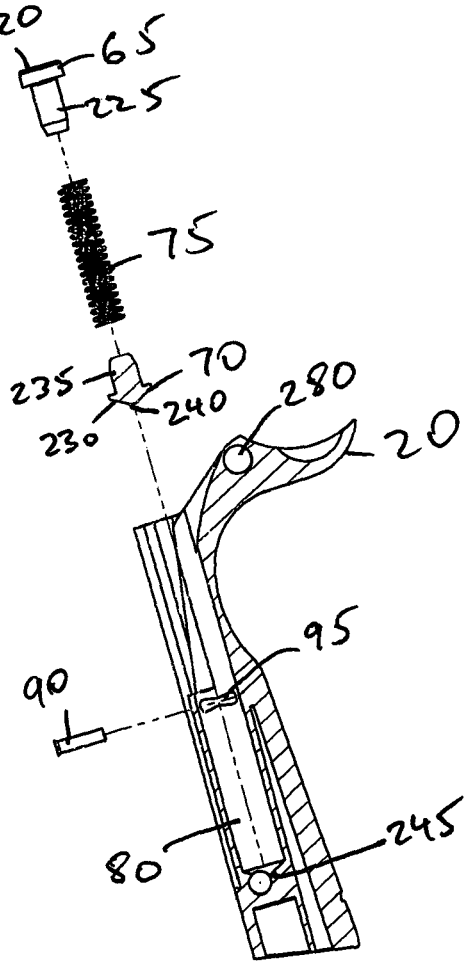
FIG. 6*b* depicts an exploded, side view of the backstrap assembly according to some embodiments presently disclosed.
Figure 7:
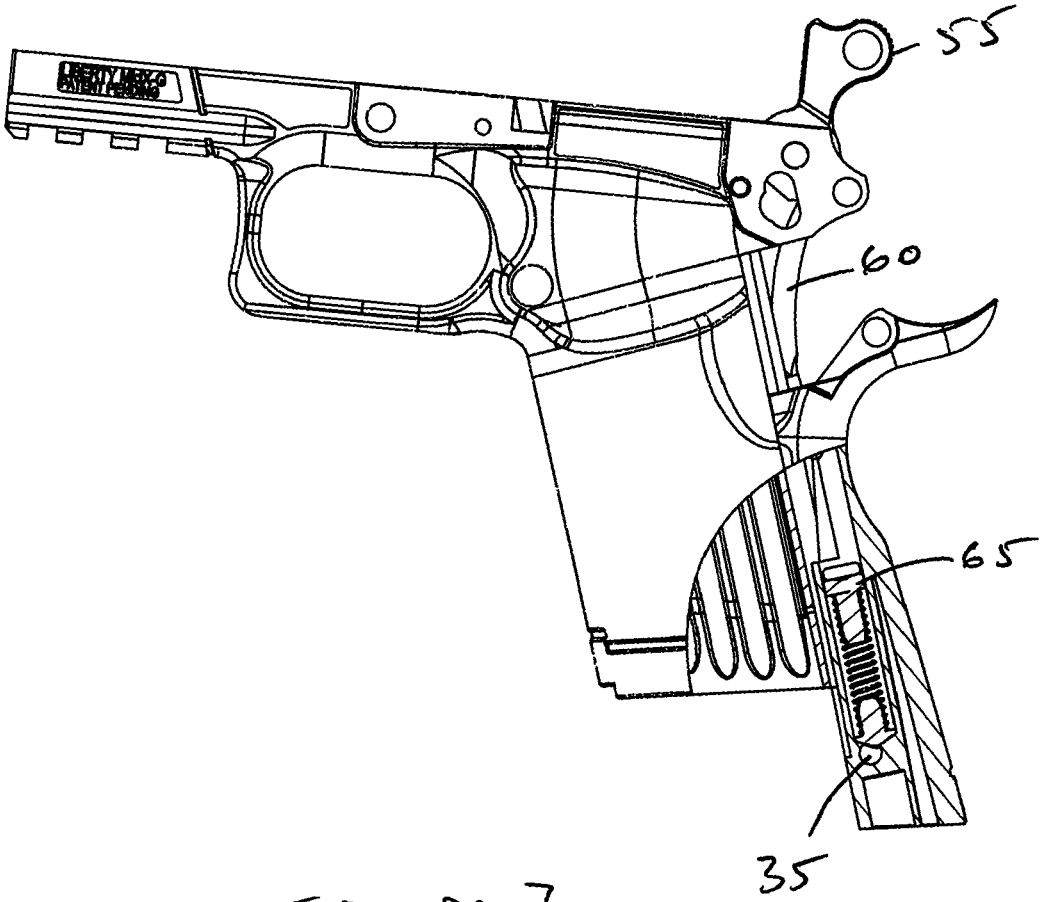
FIG. 7 depicts a cut-away, side view of the backstrap assembly according to some embodiments presently disclosed separated from the handgun.

According to some embodiments presently disclosed, the backstrap assembly 20 comprises a cavity 80 (shown in FIGS. 5*a-b* and 6*a-b*) sized to accommodate the main spring cap 65, the main spring retainer 70, and the main spring 75 (shown in FIGS. 6*a-b* depicting a cutaway view of the backstrap assembly 20). According to some embodiments presently disclosed, the main spring retainer 70 is placed in the cavity 80 first, followed by the main spring 75, and followed by the main spring cap 65. A pin 90 is inserted into the opening 95 to prevent the main spring cap 65, the main spring retainer 70, and the main spring 75 from dropping out of the cavity 80. According to some embodiments presently disclosed, the main spring cap 65, the main spring retainer 70, and the main spring 75 are compressed down before the pin 90 is inserted into the opening 95. When the backstrap assembly 20 is coupled with the grip 25, the grip 25 prevents the pin 90 from coming out of the opening 95.

Figure 9:
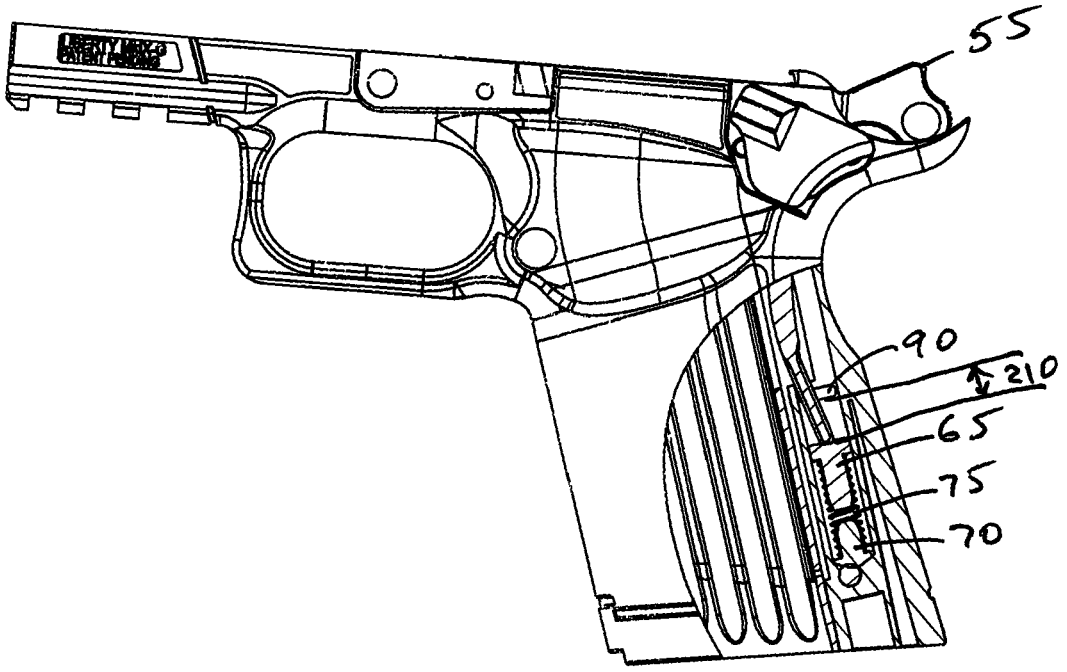
FIG. 9 depicts another cut-away, side view of the backstrap assembly according to some embodiments presently disclosed coupled with the handgun.

According to some embodiments presently disclosed, when the backstrap assembly 20 is sliding up the tongues 50, the lower end 62 of the strut 60 abuts the main spring cap 65. According to some embodiments presently disclosed, the lower end 62 of the strut 60 is positioned within the cavity 80 when the backstrap assembly 20 is installed on the grip 25. According to some embodiments presently disclosed, the strut 60 compresses the main spring 75 when the backstrap assembly 20 is installed on the grip 25 and the hammer 55 is in the lowered position as shown in FIG. 9.

Figure 8:
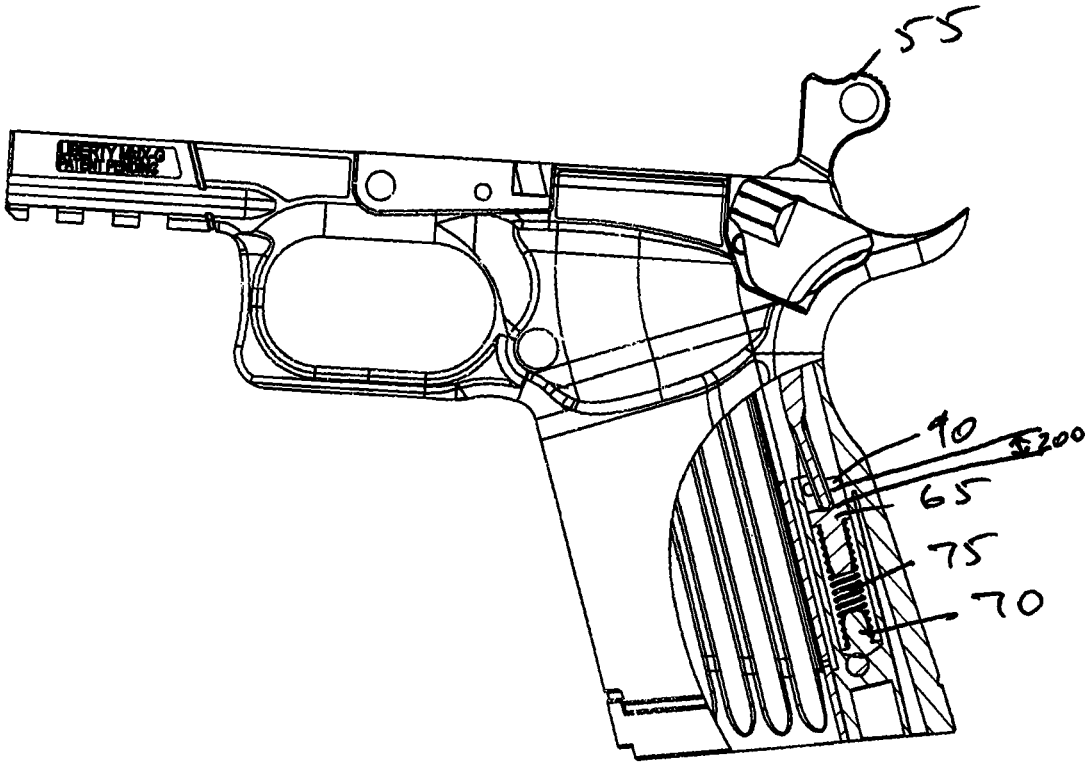
FIG. 8 depicts a cut-away, side view of the backstrap assembly according to some embodiments presently disclosed coupled with the handgun.

According to some embodiments presently disclosed, the strut 60 compresses the main spring 75 a first distance 200 from the pin 90 when the backstrap assembly 20 is installed on the grip 25 and the hammer 55 is in the upper position as shown in FIG. 8. According to some embodiments presently disclosed, the strut 60 compresses the main spring 75 a second distance 210 from the pin 90 when the backstrap assembly 20 is installed on the grip 25 and the hammer 55 is in the lower position as shown in FIG. 9. The second distance 210 is greater than the first distance 200.

According to some embodiments presently disclosed, the main spring cap 65 comprises a cap portion 220 and a post portion 225. The cap portion 220 is wider then the post portion 225. According to some embodiments presently disclosed, the post portion 225 is positioned within the main spring 75 and the cap portion 220 is positioned above the main spring 75 (shown in FIG. 6*a*).

According to some embodiments presently disclosed, the main spring retainer 70 comprises a cap portion 230 and a post portion 235. The cap portion 230 is wider then the post portion 235. According to some embodiments presently disclosed, the post portion 235 is positioned within the main spring 75 and the cap portion 220 is positioned below the main spring 75 (shown in FIG. 6*a*).

According to some embodiments presently disclosed, the cap portion 230 of the main spring retainer 70 is narrower at point 240 located away from the post portion 235. According to some embodiments presently disclosed, the bottom of the cavity 80 comprises a narrower point 245 configured to accommodate the point 240.

Figure 11:
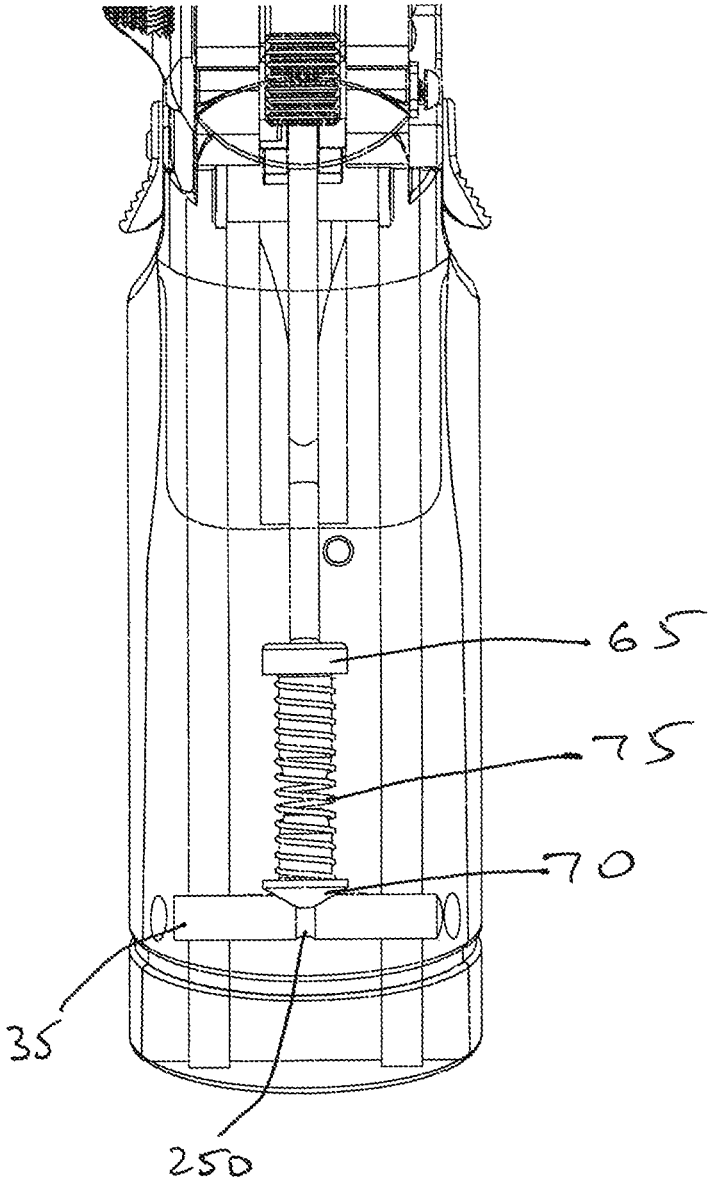
FIG. 11 depicts a cut-away, rear view of the backstrap assembly according to some embodiments presently disclosed coupled with the handgun.

According to some embodiments presently disclosed, the coupling pin 35 comprises a notch 250 (shown in FIG. 5*b*) configured to accommodate the narrower point 240. Once the coupling pin 35 is inserted into the opening 40, the narrower point 240 is positioned within the notch 250 and prevents the coupling pin 35 from coming out of the opening 40 (shown in FIG. 11).

Figure 10:
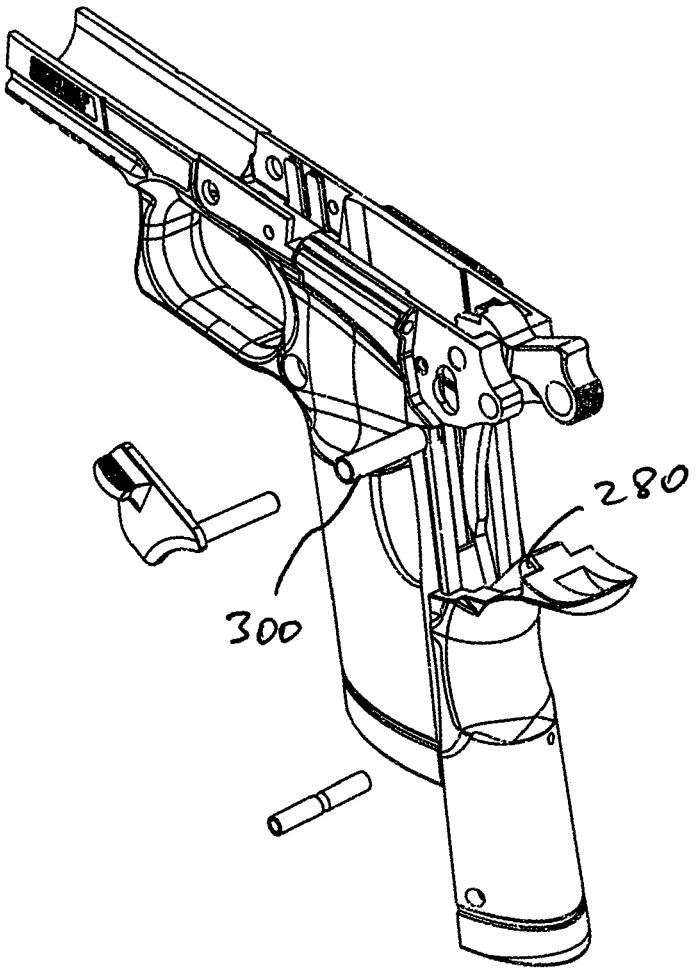
FIG. 10 depicts another perspective view of the backstrap assembly according to some embodiments presently disclosed separated from the handgun.

According to some embodiments presently disclosed, the backstrap assembly 20 comprises an opening 280 configured to line up with an opening 290 on the frame 15 when the backstrap assembly 20 is positioned on the grip 25. The openings 280 and 290 are configured to accommodate a thumb safety pin 300 as shown in FIG. 10. The thumb safety pin 300 prevents the backstrap assembly 20 from sliding down the grip 25.

Although the backstrap assembly 20 is shown being applied to a Model 1911 type firearm, it is to be understood that the backstrap assembly 20 can be applied to other types of firearms using backstrap.

While several illustrative embodiments of the invention have been shown and described, numerous variations and alternative embodiments will occur to those skilled in the art. Such variations and alternative embodiments are contemplated, and can be made without departing from the scope of the invention as defined in the appended claims.

As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

What is claimed is:

1. A backstrap assembly comprising:

a cavity sized to retain a main spring cap, a main spring retainer, a main spring, and a lower end of a strut;

a pin;

an opening for the pin, wherein the pin retains the main spring cap, the main spring retainer, and the main spring in the cavity;

a coupling pin comprising a notch; and a plurality of openings for the coupling pin, wherein the coupling pin prevents the backstrap assembly from slidably decoupling from a firearm;

one or more grooves for slidably coupling the backstrap assembly with the firearm; a first surface positioned adjacent to the firearm when the backstrap assembly is coupled with the firearm, wherein the one or more grooves are formed into the first surface, and wherein the opening for the pin is formed into the first surface;

wherein a portion of the main spring retainer is positioned within the notch to prevent removal of the coupling pin from the plurality of openings.

2. The backstrap assembly of claim 1 wherein a grip of the firearm prevents removal of the pin from the opening when the backstrap assembly is coupled with the firearm.

3. The backstrap assembly of claim 1 further comprising another opening configured to accommodate a thumb safety pin.

4. A firearm comprising:

a frame comprising a grip;

a main spring cap;

a main spring retainer;

a main spring;

a backstrap assembly slidably coupled with the grip, the backstrap assembly comprising a cavity, wherein the main spring cap, the main spring retainer, and the main spring are positioned within the cavity;

a pin to retain the main spring cap, the main spring retainer, and the main spring in the cavity;

a coupling pin comprising a notch; and a plurality of openings for the coupling pin, wherein the coupling pin prevents the backstrap from slidably decoupling from a firearm;

wherein a portion of the main spring retainer is positioned within the notch to prevent removal of the coupling pin from the plurality of openings;

wherein the grip comprises one or more tongues and the backstrap comprises one or more grooves;

wherein the one or more tongues engage the one or more grooves to couple the backstrap assembly with the grip;

wherein the backstrap assembly further comprises a first surface positioned adjacent to the grip when the backstrap assembly is coupled with the firearm, wherein an opening for the pin is formed into the first surface, wherein the one or more grooves are formed into the first surface.

5. The firearm of claim 4 wherein the grip prevents removal of the pin when the backstrap assembly is coupled with the grip.

6. The firearm of claim 4 further comprising another opening configured to accommodate the pin, wherein the another opening is positioned between the backstrap assembly and the grip when the backstrap assembly is coupled with the grip.

7. The firearm of claim 6, wherein the backstrap assembly further comprises a first surface abutting the grip when the backstrap assembly is coupled with the firearm.

8. The firearm of claim 4 wherein the one or more tongues comprise one or more notches for engaging the coupling pin.

9. The firearm of claim 4, a second surface positioned adjacent to the first surface of the backstrap assembly when the backstrap assembly is coupled with the firearm, wherein the one or more tongues are positioned along the second surface.

10. The firearm of claim 4, wherein the grip comprises a second surface positioned adjacent to the first surface of the backstrap assembly when the backstrap assembly is coupled with the firearm, wherein the one or more tongues extend from the second surface.

11. The firearm of claim 4, wherein the backstrap assembly further comprises comprising a second surface, wherein at least one of the plurality of openings for the coupling pin is positioned along the second surface.

* * * * *